United States Patent [19]

Ingemann

[11] Patent Number: 4,795,055

[45] Date of Patent: Jan. 3, 1989

[54] CONTAINER HAVING A PULL RING FOR SEPARATION AND REMOVAL OF A LID

[75] Inventor: Ole Ingemann, Ryslinge, Denmark

[73] Assignee: PLM AB, Malmo, Sweden

[21] Appl. No.: 46,048

[22] PCT Filed: Aug. 18, 1986

[86] PCT No.: PCT/SE86/00373

§ 371 Date: Apr. 16, 1987

§ 102(e) Date: Apr. 16, 1987

[87] PCT Pub. No.: WO87/01095

PCT Pub. Date: Feb. 26, 1987

[30] Foreign Application Priority Data

Aug. 16, 1985 [SE] Sweden ..... 8503830

[51] Int. Cl.[4] ..... B65D 17/34

[52] U.S. Cl. ..... 220/270; 220/257; 220/258

[58] Field of Search ..... 220/260, 270, 276, 257, 220/258

[56] References Cited

U.S. PATENT DOCUMENTS 3,552,634 1/1971 Ollier et al. ..... 220/257

4,501,375 2/1985 Katsura ..... 220/270

4,555,056 11/1985 Bernhardt ..... 220/257

*Primary Examiner*—George T. Hall

*Attorney, Agent, or Firm*—Roberts, Spiecens & Cohen

[57] ABSTRACT

An easily-opened container includes a container body (11) with an opening portion and a lid (20) cooperating with the opening portion. The lid has a central lid portion (29) and a peripheral portion located outside this lid portion and sealingly and permanently fixed to the opening portion for closing the container. The central lid portion and the peripheral portion are separated from one another by a weakened portion (22) which extends in the circumferential direction of the opening portion and at least partially around the opening portion. In a restricted region, the opening portion is provided with a recess (17) located beneath the weakened portion. A stripping unit (50) with fulcrum-effect is pivotably supported in a support region (100). The stripping device has a pull member (51) and a pressure member (54), the latter abutting against the outer surface of the lid inside the weakened portion and above the recess in order, on lifting of the pull member, to realize, by pressure against the above-mentioned region, material rupture in the weakened portion and thereby initiate opening of the container.

13 Claims, 5 Drawing Sheets

CONTAINER HAVING A PULL RING FOR SEPARATION AND REMOVAL OF A LID

FIELD OF THE INVENTION

The present invention relates to an easily-opened container comprising a container body with an opening portion and a sealed bottom portion, a lid with a central lid portion and a peripheral portion disposed outside the lid portion, and one or more connecting devices which sealingly fixing the lid to the container body for sealing of the container and an opening means. The opening means includes a weakened portion located in the lid and formed by a region of material of reduced strength, the weakened portion being located inside the connecting devices and extending in the circumferential direction of the opening portion and at least partially around the opening porton. In the weakened portion, the central section is separable from adjacent regions of the peripheral portion. The opening means further includes means for facilitating the above-mentioned separation.

BACKGROUND OF THE INVENTION

In many contexts, there is a need for easily-opened containers. In many physical applications, there are also requirements that the opened container may be readily resealable. As a rule, the requirement of ready reclosure prevails in situations where the container is gradually emptied of its contents in individual stages. Such batchwise emptying of a container is often employed when the container is used for the storage of foods.

A further requirement placed on a container for the above-outlined purposes is that it must, as far as is possible, be of a construction which safeguards against unintentional opening. In particular, in physical applications in which the lid of the container is provided with a weakened portion, for example, a circumferential weakened zone, there may be a risk of such intentional opening when the lid portion inside the weakened zone is exposed to compressive forces.

SUMMARY OF THE INVENTION

An object of the present invention is to provide a container in which the above-outlined requirements have been satisfied.

According to the invention, the opening portion of the container body is, in a defined region, provided with a depression or recess located beneath the weakened portion. The opening means includes a fulcrum-action unit pivotably supported on the container body at a fulcrum and including a pull member and a pressure member located on opposite sides of the fulcrum. The pressure member rests against the outer surface of the lid in the region of, or adjacent to, the weakened portion at a location above the depression or recess. On raising of the pull member, a lever action is created about the fulcrum to cause the pressure member to produce rupture of the weakened portion. When the weakened portion has been ruptured or relatively slight forces are necessary to continue opening of the container by stripping at the weakened portion.

In one preferred embodiment of the present invention, the, pull unit is fixed to the central lid portion, preferably fulcrum-effect is fixed to the central lid portion by means of a rivet-like arrangement of plastic material. In fields of application in which the lid consists of plastic material, the rivet-like arrangement also consists, as a rule, of plastic material. When the rivet-like arrangement consists of plastic material, it generally constitutes an integral part of the lid.

In one embodiment of the present invention, the pressure member terminates in the region most distal from the support point by an edge which is located above the weakened portion. The pull member can be constituted as a pull-ring.

In yet a further preferred embodiment of the present invention, the opening portion is provided with a flared flange to which the peripheral portion of the lid is sealingly fixed. In certain applications, the peripheral portion of the lid consists of a flared flange.

Generally, the central peripheral portion of the lid is located at a lower level than the flared flange of the lid, while in other applications, the central portion of the lid can be located flush with or higher than its flared flange.

In still a further preferred embodiment of the present invention, each connecting member consists of a weld which, in containers of plastic material, is preferably formed by ultrasonic welding.

In certain applications, in which the material of the container is crystallized plastic the weakened portion consists of a material region of reduced cyrstallization.

BRIEF DESCRIPTION OF THE FIGURES OF THE DRAWING

The nature of the present invention and its aspects will be more readily understood from the following brief description of the figures of the accompanying drawings, and discussion relating thereto.

In the accompanying drawings.

DETAILED DESCRIPTION OF PREFERRED EMBODIMENTS

Figure 1:
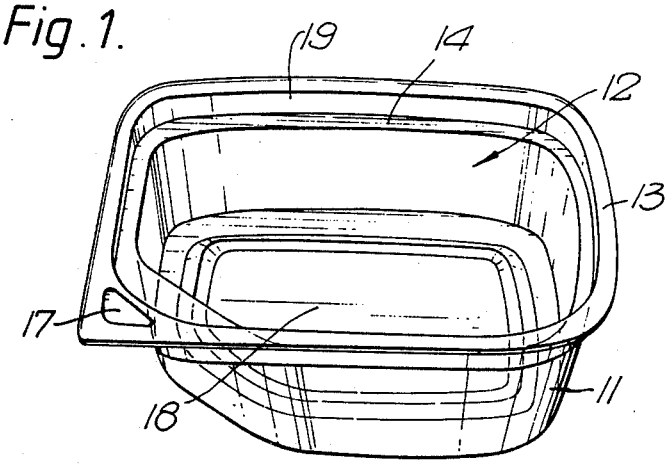
FIG. 1 is a top perspective view of a container body which for part of the container of the invention.
Figure 2:
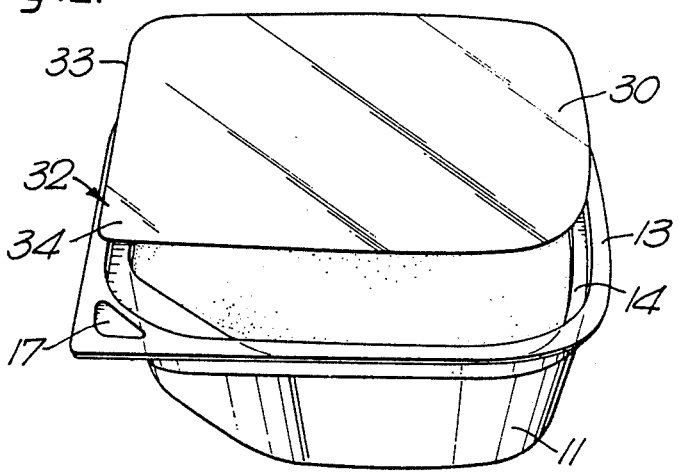
FIG. 2 shows the container body of FIG. 1 in filled condition with an inner lid ready for application.

In a drawing, a container 10 is shown comprising a container body 11 having a closed bottom portion 18. The container body has an opening 12 which is bounded by an anchorage portion 13 for a lid 20. Between the anchorage portion 13 and the bottom portion 18, the container body 11 is provided with a shoulder 14 which extends in the circumferential direction of the container and, in one preferred embodiment, throughout the entire circumference of the container. The shoulder 14 serves as a support constitutes a substrate for a supplementary, inner lid or membrane 30. The shoulder 14 provided with at least one circumferentially oriented and upwardly directed bead 15 (cf. FIG. 9), which has a bulge 16 in a region where separation of the inner lid is commenced. In same applications, the shoulder is primarily provided to offer support at the opening 12, while in other applications, its primary duty is to constitute an arrest means which, on resealing of the container, restricts the movement of the lid 30 towards the bottom portion. The present invention also contemplates embodiments in which the shoulder or its counterpart is omitted. Nevertheless, it will be obvious to those skilled in the art that one of the above-disclosed functions of the shoulder does not preclude the others.

In certain embodiments, the container body is provided, between the shoulder 14 and the anchorage portion 13, with a wall porton 19, the material of which is preferably oriented substantially in the axial direction of the container body. The anchorage portion 13 also has a recess or depression 17. The recess 17 is located, in one preferred embodiment, immediately adjacent one of the corners of the container. As a result, its effect on the storage space of the container will be reduced to a minimum, and, at the same time, opening of the container starts in a favourable region from the point of view of broaching and opening, in other words as regards the direction of the tractive forces required for the continued stripping and opening process, once the weakened portion has been broached. In certain embodiments, the container body is provided with a layer of barrier material 40 which, for example, may consist of aluminum foil, ethylvinyl alcohol, polyvinyl dichloride etc.

Figure 3:
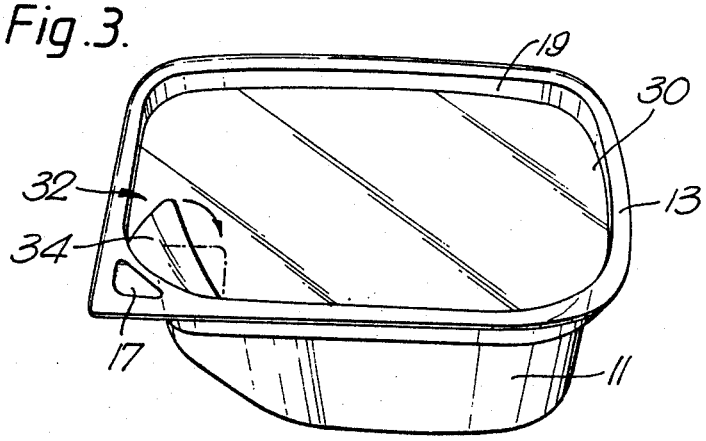
FIG. 3 shows the container body of FIG. 2 with the inner lid installed thereon.

The dimensions of the inner lid 30 are adapted to the opening 12 of the container body in order to be insertable and sealingly fixed in the opening, for example, at the shoulder 14. In one preferred embodiment of the present invention, such fixation is effected against the bead 15, for example by heat sealing. The inner lid 30 is provided with a gripping member 32 at its bounding edge 33, the gripping member being shown in FIG. 3 as a flap 34, but may, in other embodiments, also consist of a folded-over portion of the edge 33 which extends along a shorter or longer extent of the circumference of the inner lid 30. In certain embodiments, a layer of barrier material 41 is included in the inner lid, for example, barrier material of the above-described types.

Figure 4:
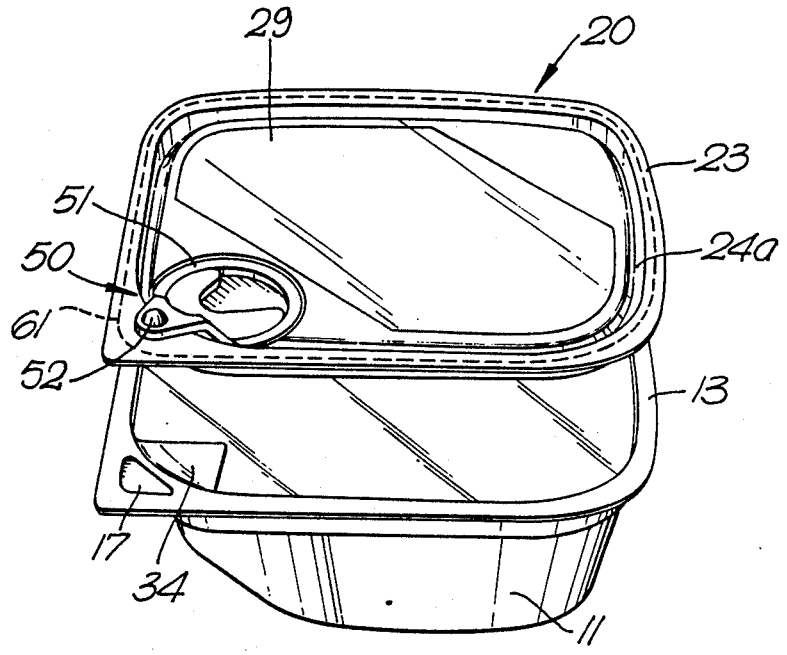
FIG. 4 shows the assembly of FIG. 3 with an outer lid ready for application.
Figure 5:
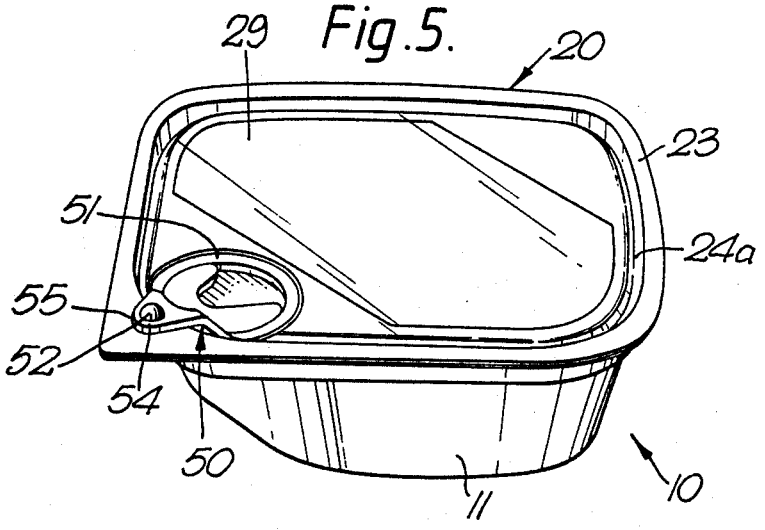
FIG. 5 shows the assembly of FIG. 4 with the outer lid installed thereon.
Figure 8:
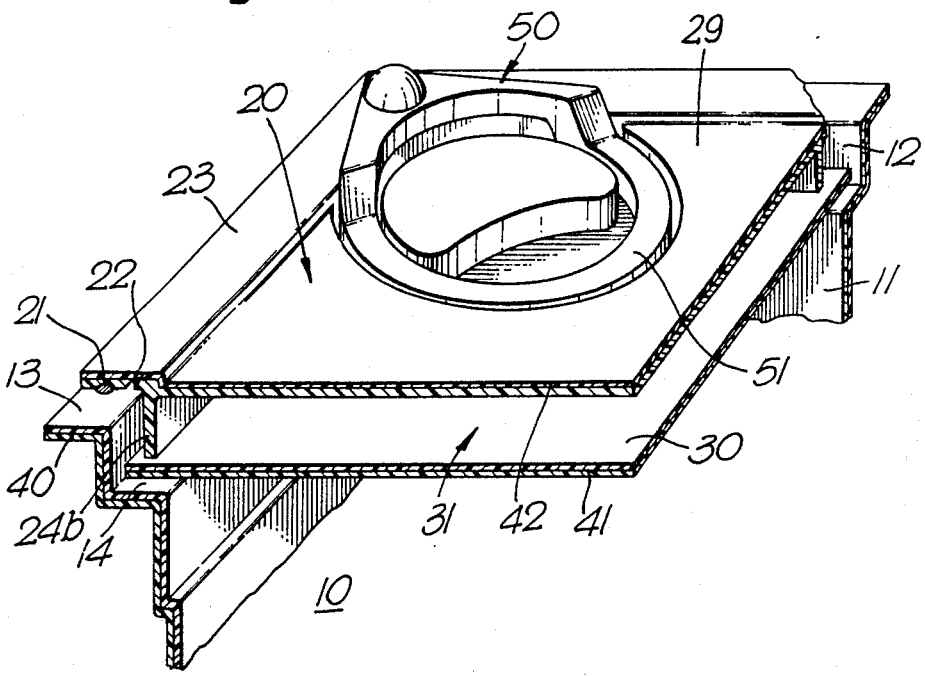
FIG. 8 is a perspective view of a portion of the container, on an enlarged scale and partly in section.

The lid 20, hereinafter occasionally designated a first lid or outer lid—with no restrictive implication to the scope of the present invention—is shown with an anchorage portion 23 corresponding to the anchorage portion 13 of the container body. Through the intermediary of a weakened portion (stripping line 22, cf. FIG. 8), the anchorage portion 23 merges, with a central lid portion 29 which, on opening of the container, constitutes that portion of the lid which is removed from the container. The central lid portion is, as a rule, provided, in the region adjacent the stripping notch 22, with a depending portion 24*a,b* (cf. FIGS. 4 and 8), the depth of which in a direction towards the bottom is adapted to the distance to the above-mentioned shoulder 14, such that the depending portion extends into proximity with the shoulder 14. In certain embodiments of the present invention, a layer 42 of barrier material is also included in the lid, for example of the above-indicated types.

The anchorage portion 13 of the container body is sealingly connected to the anchorage portion 23 of the first lid 20 by a permanent connection 21 which, in one preferred embodiment of the present invention (of FIG. 8), consists of a welded joint, for example, realized by ultrasonic welding. In order to locate the welded joint and facilitate its formation, at least one of the anchorage portions 13, 23 is provided with at least one welding cam 61 facing the other anchorage portion. The position of such a welding cam is indicated by reference numeral 61 in FIG. 4.

Figure 10A:
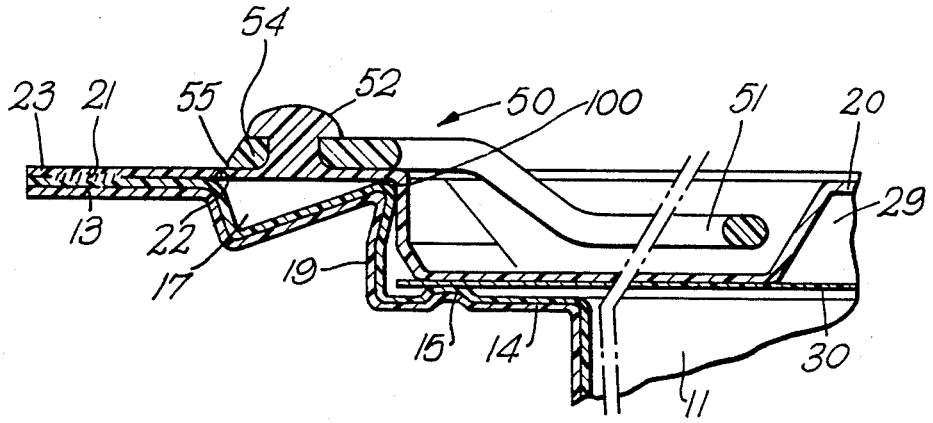
FIGS. 10*a* and 10*b* are sectional views through a portion of the container respectively in the sealed state and in a partially opened state.
Figure 10B:
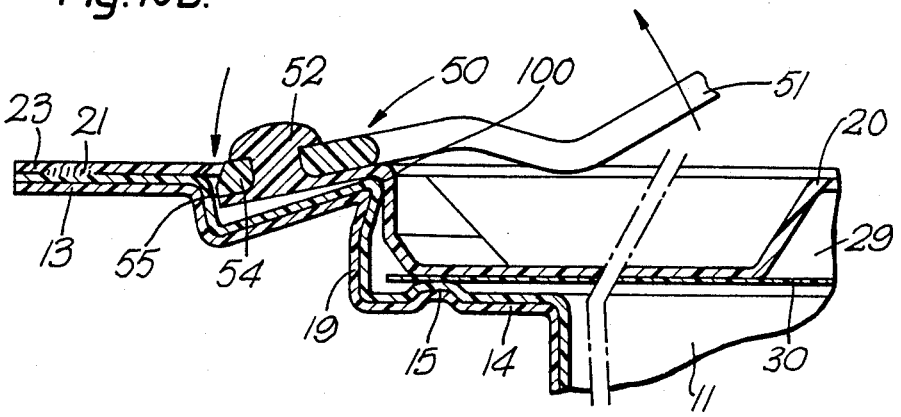

The first lid 20 is provided with a stripping device 50 fitted with a pull-ring 51 located on one side of a fixation member 52 which secures the stripping device 50 to the first lid 20. The fixation member 52 is in the form of a rivet which is integral with the lid 20. The pull-ring 51 is seated in a recess in the lid 20 as evident from FIGS. 8 and 10*a* in order to be retracted below the surface of the lid in the sealed condition of the container. The stripping device 50 is provided, on the other side of the fixation member 52, with a projecting portion 54, which, in one preferred embodiment of the present invention, terminates at an end edge 55 abutting against the outer surface of the lid 20. The stripping device 50 consists of a relatively rigid material, preferably a plastic material. In or beside the fixation region, the opening 12 bounded by a mechanically stable edge 100 which forms a transition between the substantially vertical wall portion 19 and the recess 17. The stripping device so rests on edge 100 which forms a fulcrum for the stripping device. Since the distance between the stable edge 100 and the gripping portion of the pull-ring 51 is greater than the distance between the edge 100 and the edge 55 of the projecting portion, a mechanical advantage will be created when the pull-ring is raised, which intensifies the force at and facilitates rupture along the weakened notch 22.

The weakened portion is illustrated and described as having been formed by the groove-like notch 22, but it is obvious to those skilled in the art that in certain embodiments, the weakened portion could be formed, by treating the plastic material to reduce the strength of the material, for example the material could be heat-treated to alter its crystallinity. Similarly, the weakened portion is shown in the form of closed loop, but it is obvious that, in certain physical applications, the weakened portion may be disposed over only a portion of the circumference of the container opening so that, on opening of the container, the central lid portion 29 of the first lid 20 will remain secured to the container body.

Figure 6:
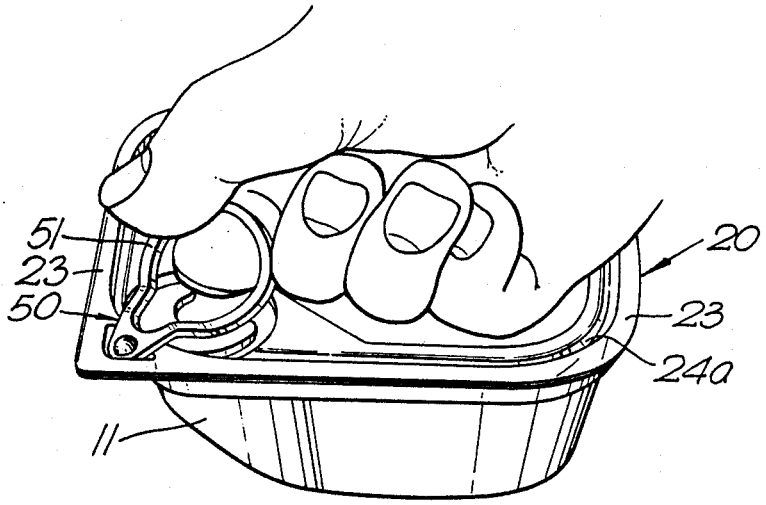
FIG. 6 shows the assembly of FIG. 5 in a first stage of opening the container.
Figure 7:
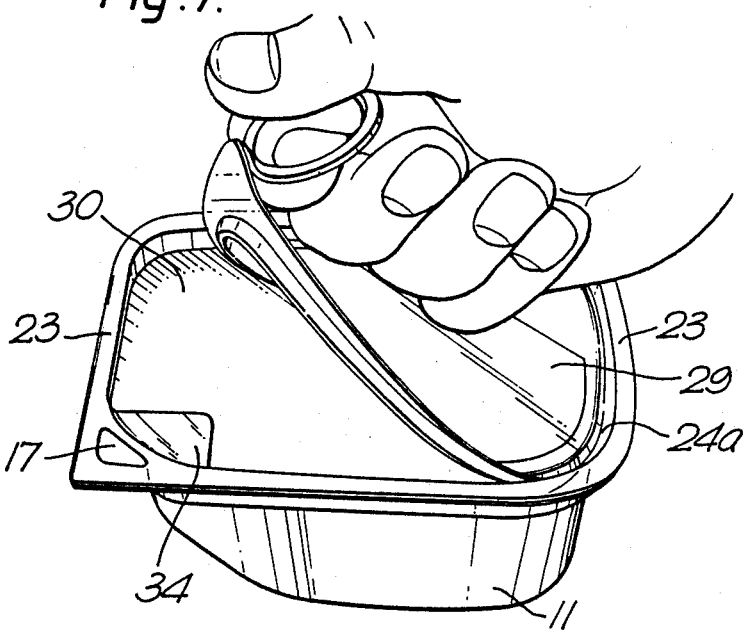
FIG. 7 shows the outer lid of the container in a partially opened condition.

When a container according to the present invention is to be put into use, it is filled with the desired goods, whereafter the second lid 30 (where applicable) is mounted in place and sealingly fixed against the container body 11. Thereafter, the first lid 20 is applied and is also sealingly fixed to the container body 11. When the container is opened, the central lid portion 29 of the lid 20 will be separated wholly or partly from the anchorage portion 23 which, in the illustrated embodiments, is effected by means of the stripping device 50. When the pull-ring 51 is raised, the stripping device ruptures the connection of the central lid portion 29 to the anchorage portion 23 by serving the weakened portion 22. When portion 22 has been severed, only relatively small forces are required for the continued removal of the lid 20 (cf. FIGS. 6 and 7). Once the central lid portion 29 of the first lid has been removed, the second lid 30 (where applicable) is removed, by means of the gripping device 32. The container is thereafter fully open and its contents may be used.

The central lid portion 29 of the first lid 20 is suited for reclosure of the container in that the depending portion 24 projecting towards the bottom constitutes, in certain embodiments of the present invention, arrest means which, in cooperation with the shoulder 14, restricts the movement of the central lid portion in a downward direction in the container. This particularly applies when the weakened portion is disposed substantially in alignment with the inner surface of the wall portion 19 of the container body. In certain embodiments, the weakened portion 22 is placed such that, once the weakened portion has been ruptured, there remains a flared flange on the central lid portion 29 of the lid 20, this flange, in cooperation with the anchorage portion 13 of the container body, restricting movement of the lid portion 20 towards the bottom of the container. As a result of the above-mentioned positioning of the weakened portion, the material of the lid of the factory-sealed container is supported on both sides of the weakened portion by the anchorage portion 23. This arrangement prevents the weakened portion from rupturing due to external pressure against the inner lid portion 29 in the region of the weakened portion. The depending portion 24*a,b* of the lid portion is, as a rule, dmentioned so as to abut against the inner wall surrounding the opening 12 and thereby realize a sealing upon reclosure of the container.

Figure 9:
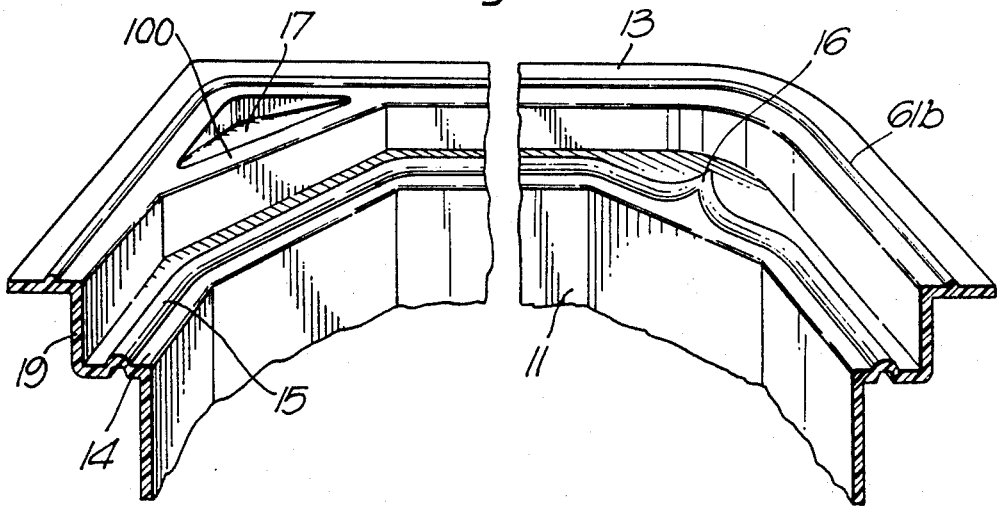
FIG. 9 is a perspective view of a portion of the container body of the container, on enlarged scale and partly in section.

FIG. 9 illustrates an embodiment of the container in which the regions for initiation of opening of the first lid 20 and the second lid 30, respectively, are located in spaced apart relationship. This requires the central lid portion 29 of the first lid to be raised a relatively great distance before the gripping member 32 of the second lid becomes accessible, with the result that any unauthorized tampering with the container will readily become noticeable.

Figure 11:
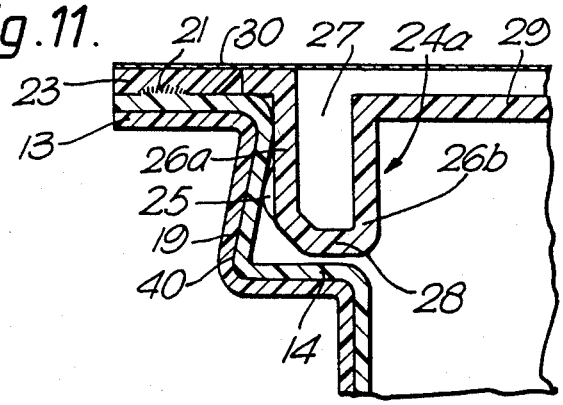
FIG. 11 is a sectional view through a portion of another embodiment of a container according to the invention.

FIG. 11 shows a partial section through the opening portion of another embodiment of the first lid 20. The partial section is located at the stripping device. At its depending portion 24*a*, the lid is provided with one or more projecting portions 25 which cooperate with the substantially vertical wall portion 19 of the container body in the region between the shoulder 14 and the anchorage portion 13 in order, together with the wall portion, to form a snap engaging function. To this end, the wall portion 19 is slightly inclined downwardly and outwardly. In order to attain a certain spring action in the depending portion 24*a* of the lid, this portion is, in the embodiment illustrated in FIG. 11, composed of two substantially vertical wall portions 26*a,b* which are interconnected by a substantially horizontal wall portion 28 and, together with the vertical wall portions, forms a channel-like groove 27. This described construction also allows the lid to be manufactured by thermoforming. In the drawing, the containers have been illustrated with polygonal cross-section. However, it is obvious to a person skilled in the art that the present invention is applicable also to containers of any optional cross-sectional configuration, for example circular, oval, or combinations which include parts of polygonal and curved lines.

Even though the embodiments of the present invention described above comprise, as a rule, an inner and an outer lid, it will be obvious to a person skilled in this art that the present invention also embraces containers provided with only a single lid with designs corresponding to that described above for the first (outer) lid.

The above detailed description has referred to a limited number of embodiments of the present invention, but those skilled in the art will readily perceive that the present invention contemplates a large number of embodiments which fall within the spirit and scope of the appended claims.

What is claimed is:

1. An easily-opened container comprising a container body having an opening portion and a sealed bottom portion, a lid with a central lid portion and a peripheral portion located outside said central lid portion, one or more connection means which sealingly fix said lid to said container body to close said container and opening means, said opening means including a weakened portion located in said lid and formed by a material zone of reduced strength, wherein said weakened portion is located inside said connecting means and extends in the circumferential direction of said opening portion, and at least partly thereabout, said central portion being separable, at said weakened portion, from adjacent regions of said peripheral portion, said opening portion being in a restricted region, provided with a recess located beneath said weakened portion, and wherein said opening means includes a pull unit with fulcrum-effect journaled in a support region, said pull unit comprising a pull member and a pressure member, the latter abutting against the outer surface of said lid in the region of or adjacent to said weakened portion, said weakened portion being located above said recess in order, on lifting of said pull member, to realize, by pressure against said region, material rupture in said weakened portion.

2. The container as recited in claim 1, wherein said weakened portion consists of a region of reduced thickness in said lid.

3. The container as recited in claim 1 or 2, wherein said pressure member is provided with an edge located most distal from said support region, said edge being located substantially above said weakened portion.

4. The container as recited in claim 1, wherein said lid is manufactured of crystallizable plastic material and said weakened portion consists of a material region which, by crystallization, has reduced strength.

5. The container as recited in claim 1, wherein said opening portion is provided with a flared flange to which the peripheral portion of said lid is sealingly fixed.

6. The container as recited in claim 5, wherein said peripheral portion of said lid forms a second flared flange.

7. The container as recited in claim 1, wherein said recess is disposed in conjunction with a corner of said opening portion of said container.

8. The container as recited in claim 5 or 6, wherein each connection means consists of a weld.

9. The container as recited in claim 8, wherein the weld is formed by ultrasonic welding, said container being made of plastic material.

10. The container as recited in claim 1, wherein said pull unit is fixed to the central lid portion.

11. The container as recited in claim 10, wherein said pull unit is fixed to said central lid portion by means of a rivet-like arrangement of plastic material.

12. The container as recited in claim 11, wherein said rivet-like arrangement consists of a part integral with said lid.

13. The container as recited in claim 1, wherein said pull member comprises a pull-ring.

* * * * *